United States Patent [19]

Loecker

[11] Patent Number: 4,937,951

[45] Date of Patent: Jul. 3, 1990

[54] SYSTEM FOR SECURING A FOOT OR INNER SHOE IN A SKI BOOT OR CLIMBING BOOT

[75] Inventor: Josef Loecker, Voitsberg, Austria

[73] Assignee: Koflach Sport Cesellschaft m.b.H., Voecklebruck, Austria

[21] Appl. No.: 130,991

[22] PCT Filed: Mar. 20, 1987

[86] PCT No.: PCT/AT87/00018

§ 371 Date: Nov. 19, 1987

§ 102(e) Date: Nov. 19, 1987

[87] PCT Pub. No.: WO87/05473

PCT Pub. Date: Sep. 24, 1987

[30] Foreign Application Priority Data

Mar. 21, 1986 [AT] Austria ..... 763/86

[51] Int. Cl.[5] ..... A43B 5/04; A43B 5/00; A43B 23/28

[52] U.S. Cl. ..... 36/119; 36/58.5; 36/113

[58] Field of Search ..... 36/117–121, 36/58.5, 114, 113; 128/611

[56] References Cited

U.S. PATENT DOCUMENTS

| | | | |
|---|---|---|---|
| 4,160,332 | 7/1979 | Salomon | 36/119 |
| 4,583,306 | 4/1986 | Paris | 36/119 |
| 4,590,691 | 5/1986 | Oliviero | 36/119 |
| 4,620,379 | 11/1986 | Sartor | 36/119 |
| 4,653,204 | 3/1987 | Morell et al. | 36/117 |
| 4,698,922 | 10/1987 | Sartor | 36/119 |
| 4,719,709 | 1/1988 | Vaccari | 36/117 |

FOREIGN PATENT DOCUMENTS

| | | | |
|---|---|---|---|
| 0030225 | 6/1981 | European Pat. Off. | 36/113 |
| 0053340 | 6/1982 | European Pat. Off. . | |
| 0114209 | 8/1984 | European Pat. Off. . | |
| 0232218 | 1/1987 | European Pat. Off. | 36/120 |
| 0226857 | 7/1987 | European Pat. Off. | 36/119 |
| 2907163 | 8/1980 | Fed. Rep. of Germany | 36/120 |
| 3524792 | 1/1986 | Fed. Rep. of Germany | 36/119 |
| 2536965 | 6/1984 | France . | |

*Primary Examiner*—James Kee Chi
*Attorney, Agent, or Firm*—Peter E. Rosden

[57] ABSTRACT

System for securing a foot or inner shoe (4) in a ski-boot or climbing boot, with tension elements (11) which extend from the instep to a hinged rear part (2) of the boot (1), in which the tension element or elements (11) are located in a fixable manner in the heel or Achilles' tendon region inside the hinged rear part (2) and pass over a deflection point (12) in the heel or angle region. Connected to the tension element or elements (11) is a clamping element (17) located between the deflection point in the heel or ankle region, which is linked with a clamping device (15) on the outer side of the boot. It is preferable that the tension element or elements (11) are placed in a crosswise manner in the region of the instep, whereby preferably the crossover point can be displaced in the longitudinal direction of the shoe (arrow 20).

26 Claims, 2 Drawing Sheets

SYSTEM FOR SECURING A FOOT OR INNER SHOE IN A SKI BOOT OR CLIMBING BOOT

The invention relates to a system for securing a foot or inner shoe in a ski boot or climbing boot having tension elements which extend from the instep over a deflection point to a tiltable rear part of the shoe and can be adjusted by means of a clamping element.

In arrangements of the aforementioned type, a plate located in the instep area is usually secured by means of a cable line extending over a deflection point situated on the periphery of the tiltable rear part through a tightening buckle having a swivel axis oriented essentially transversely with respect to the longitudinal axis of the shoe. The improvement in hold of the foot in the shoe of these types of constructions results primarily from drawing the heel of the foot towards the back of the shoe through a thightening force applied to the instep plate. The large forces often applied to tension elements of this type also result in the application of a more or less high force to the tiltable rear part, due to the forward position of the rear flap. Whenever the swivel axis of the tiltable rear part is not identical with the deflecting point, for kinematic reasons, a corresponding change in the tightening force also occurs due to swivelling of the rear flap, a change which would also occur unintentionally, particularly during skiing, due to the more or less extensive forward pressures exerted on the trunk of the shoe. In order to minimize this effect, in devices in the prior art, the deflecting point for tension elements as a rule is arranged close to the outer contour of the tiltable rear part, and the tension element is led through the shell at the deflecting point and is deflected to the exterior side of the tiltable rear part.

A system of the aforementioned type is found, for example, in EP-A-No. 53 340, in which the deflecting points may, for example, be formed by tubes embedded in the material of the shell. In this known type of structure, the tension elements are steel cables which are flexibly applied to a tongue part, extending, like a saddle, over the front side of the shell.

A main object of this invention is to provide a system of the aforementioned type in which, largely without regard to the position of the trunk of the shoe relative to the shell, a definable tightening force can be introduced into a tension element in the interior of the shoe which permits a securing of the foot or inner shoe in the interior of the shell without introducing a one-sided pull in the direction of the heel. Thus, according to the innovative structure disclosed herein, a stabilization and securing of the inner shoe or foot is achieved in such a way that not only is the heel of the foot pressed toward the rear of the shoe by means of the tightening force but also the ankle part of the foot is held in a desired position. At the same time, the invention has the objective of introducing the necessary clamping force in such a way that, even when the trunk of the shoe swivels relative to the shell, only minor fluctuations in tension force result, and that large adjustments are made possible through use of a comparatively short adjustment path. In order to achieve these objectives, the invention is comprised essentially of one or more tension element(s) in the area of the heel or, respectively, of the Achilles tendon, which is (are) secured within the tiltable rear part and is (are) guided over a deflection point located in the heel or ankle area, and which, either at the deflection point or somewhere between the deflection point in the heel or ankle area and the instep, is (are) connected with a clamping element associated with a tightening device located on the exterior surface of the shoe shell. Since a clamping element is connected to the tension element at the deflection point or between the deflection point of the tension element or tension elements in the heel or ankle area, the tightening device can be secured in a desirable manner in the instep area as well as in the trunk area at either the front or rear surface of the shoe. Since force from the clamping element is applied between the deflection point of the tension element(s) and the instep, a distribution of the force results causing a transformation in the adjustment path, so that, with a relatively short adjustment path, a corresponding predetermined distribution of force can be introduced into the rear and the front area of the shoe, as a consequence of which small movements along the adjustment path by the tightening device produce large adjustments in the tension elements inside the shoe. Since the tension element is secured within the rear area of the tiltable rear part, the tensional forces become effective here irrespective of the swivel position of the tiltable rear part. Consequently, the tension elements may be run over a plurality of deflecting points, whereby the direction of both the introduction and eventual application of force into the interior of the shoe can be predetermined precisely. The clamping element may, corresponding to a preferred embodiment of the invention, be connected with a movable second deflection point, particularly a deflection pulley or a lug, in order to guarantee that the tensional force of the tightening device is distributed evenly on both the end of the tension element extending to the instep and the end of the tension element extending to the rear of the shoe.

According to a particularly preferred embodiment of the invention, the tension element(s) originating in the rear area, runs past the side of the deflection point facing the shoe-tip and penetrates the tiltable rear part where it is connected with a tightening device, such as a tightening buckle, at the exterior surface of the tiltable rear part, said tightening device having a swivel axis extending transversely to the longitudinal direction of the shoe. By leading the tension elements ends over deflection points to a location within the tiltable rear part, it becomes possible to embrace the heel or ankle part so that, when tension is applied to the clamping element and, correspondingly, a pull is exercised on the instep plate, adjustable counterpressure can also be applied from the rear toward the front. In this way, it is ensured that the instep plate does not exclusively result in a shifting of the foot or the inner shoe toward the rear, but that this type of shifting is counteracted by a corresponding supporting force in the opposition direction. A related advantage of this type of construction is that the tension element in the area of the tiltable rear part can be connected with a shell part which extends downward to the sole and which can be elastically deformed or swivelled. Since the height of this shell part is lower than the height of the tiltable rear part, the shell part can reach over the heel area and in this way improve the hold of the heel at the sole. By means of the elastically deformable or swivelling shell part, in contrast with the prior art, but only is a shifting of the heel toward the rear counteracted, but, in addition, the fit of the heel at the sole is also improved.

The tension element can be constructed as simply a closed loop cable, thus permitting particularly simple securing of the tension element at the elastically deformable or swivelling shell part in the rear area of the shoe. As a consequence, when the attachment level of the tension element is changed, the elastically deformable rear part is deformed or swivelled to a different degree even though the adjusting path of the tension element remains unchanged. In order to avoid an excessively long swivel path of the swivelling or elastically deformable rear part at which the tension elements are secured, stops for limiting the adjusting path may be provided between the deflection point and the anchoring point in the rear area, in which case a Bowden cable may advantageously be used here. Another possibility for increasing wearing comfort arises through arranging the deflection point in the heel area so that it can be shifted to a limited degree relative to the shell in the longitudinal direction of the shoe particularly while overcoming the force of a spring, in which case, for obtaining defined force, a stationary securing of the deflection point is desirable. The deflection point of the tension elements in the heel area may advantageously be formed as a pulley, in which case the pulley may have a circumferential groove that is lined in order to increase friction, may be particularly profiled, and may have a brakable and/or blockable rotating motion.

In order to improve the adjustability of the forces that can be introduced into the instep area with the same tension element, the system is advantageously arranged such that the tension element, in the instep area, is deflected around the axes below the shell that cross the plane of the sole. The tension element or elements are advantageously guided so that they cross one another in the instep area in order to ensure a uniform distribution of force on instep raisers or instep plates.

In order to regulate this introduction of force, in the case of a predetermined tensional force exerted by the tightening device, the system may also be arranged such that at least one crossing point of the tension element or elements in the instep area, preferably the crossing point that is adjacent to the shoe tip, is connected with a hook or a lug, which can be displaced in the longitudinal direction of the shoe and can be secured in a selected position. In this way, regulation can be easily ensured, since the hook or the lug that displaces the crossing point in the instep area is connected with an adjusting element, such as a toothed rack, a tension element or a slide rod, which interacts with an actuating element, such as a pinion or a buckle, on the exterior surface of the shell.

In order to ensure an introduction of forces from the tension element into the instep area that is as uniform as possible, the pressure distribution element in the instep area is advantageously developed as overlapping tabs, in which case the tension element(s) in the instep area act(s) on the tabs reaching over the instep area, which tabs connect to the lateral edge of the sole and overlap one another in the instep area. In addition, the free ends of the tension element(s) are preferably secured on both sides of the longitudinal center plane of the shoe at the overlapping tabs in the instep area. In this way, no unpleasant pressure points occur in the lateral areas of the inner shoe or foot and that a secure hold in the toe area is achieved by means of forces that essentially effect the instep area in a normal way. The distribution of pressure by means of tabs that overlap one another makes the tensional forces of the tension elements uniform and guarantees a more favorable distribution of these forces in the instep area.

A further particularly advantageous aspect of the system is the disposition of a vertically adjustable pressure element close to or at the longitudinally adjustable crossing point which interacts with one of the tabs in the overlapping area. In this way, different instep heights can be accomodated without any change in the effective length of the tension elements and thus without any change in the tensional forces.

In the following, the invention is explained in clsoer detail by reference to an embodiment shown in the drawings.

Figure 1:
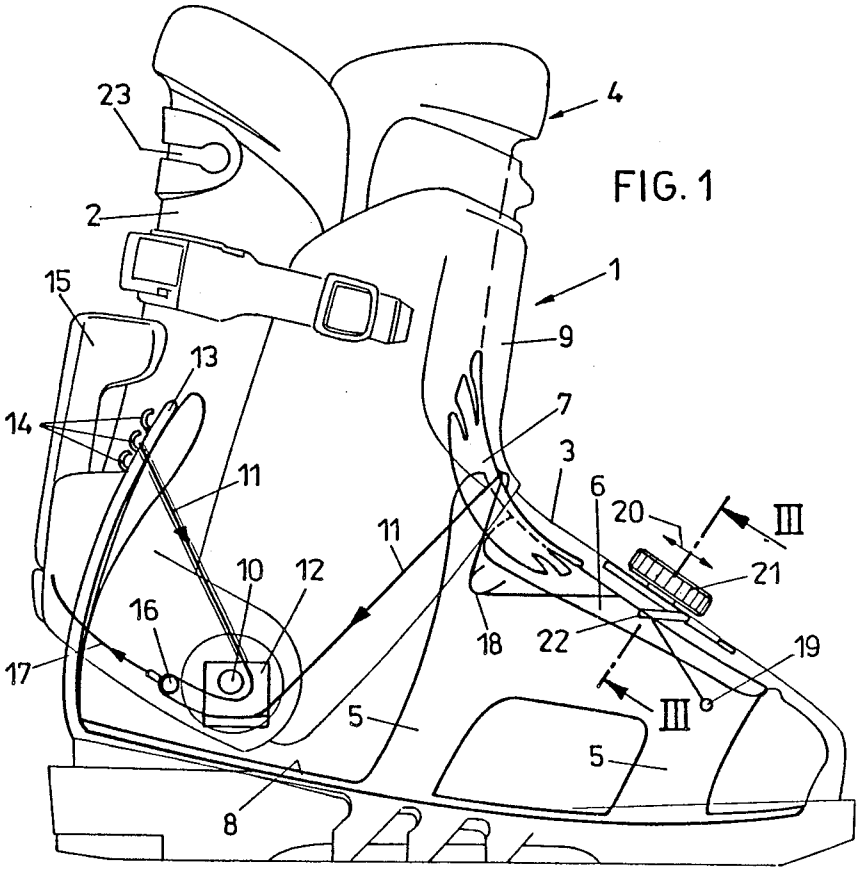
FIG. 1 is a lateral view of the system according to the invention in a ski boot.

FIG. 1 shows a ski boot 1 that has a tiltable rear part 2 as well as a shell 3 which reaches over the toe or instep region. In the interior of this ski boot 1, an inner shoe 4 as indicated in diagram form. Tabs 6 are attached in the area of the sole of shell 3 and by means of webs 5 reach over the inner shoe, or, respectively the foot, in the instep region, at which point, in addition, an instep plate 7 is provided. In order to permit good leg mobility relative to the sole 8, a cuff 9 is provided that is coupled to the shell 3 so that it can be swivelled around a swivel axis 10. The same swivel axis 10 can also be used for the swivelling of the tiltable rear part 2. To close the shoe, tiltable rear part 2 is tightened against cuff 9 by means of a conventional tightening buckle using a strap.

In the interior of the shoe and, when an inner shoe is used, between the shell 3 and the inner shoe 4, a tension element 11 composed of steel or plastic cords is arranged which is led over a component 12 having deflection points and which, in the rear region of the shoe, can be secured at an elastically deformable shell part 13. Tension element 11 may be secured at the swivelling or elastically deformable shell part 13 at three different points indicated by reference numeral 14.

Component 12 carries the deflection points for tension element 11 and may either direct the deflection by means of pulleys or may carry guides that are bent corresponding to the desired deflection. When tightening device 15 is secured, tension element 11 is guided initially from the swivelling or deformable rear part 13 past the deflection point on component 12 and is then deflected in the direction of tiltable rear part 2. After the deflection of tension element 11, a pulley 16 is applied to tension element 11, which pulley is connected with a clamping element 17. The clamping element 17 is guided to tightening device 15 which may be, for example, a simple tightening buckle. In that case, the clamping element penetrates the shell or the tiltable rear part 2, and, as a result of the arrangement of the deflection points in component 12, tensional forces are introduced through tightening device 15 which affect both the end of the tension element that is directed to the swivelling or elastically deformable rear part 13 as well as the end of the tension element that is directed to the instep plate 7. In order to limit the swivelling or deformation of the elastically deformable or swivelling rear part 13 that reaches over the heel part of the inner shoe or the foot, that end thereof which runs toward the rear may be a Bowden cable that extends between component 12 where the deflecting guides are located and the coupling point or the point where tension element 11 is secured to the elastically deformable or swivelling rear shell part 13. As a result of the selected kinematics, a predetermined tightening path of the clamping element 17 results in a correspondingly enlarged regulating distance for the tension element 11. Tension element 11 is guided along the side of the instep area over instep plate 7 and the area of tabs 6 in a way that extends over both instep plate 7 as well as the overlapping area, for the purpose of which, for example, deflecting points 18 are provided at the tabs in the instep area for tension element 11. The ends 19 of the tension element are each secured at one of the tabs 6. As a result of the crisis-crossing path of tension element(s) 11 in the area of tabs 6, the additional possibility occurs of adjusting this type of crossing point in the instep area in the direction of double arrow 20 for which purpose an adjusting device 21 is provided which interacts with a crossing point of tension element(s) 11 in the toe region. The crossing point 22 may, for example, be regulated through a lug controlled by adjusting device 21 which can be slid in the direction of double arrow 20 by means of a rack-and-pinion coupling. Adjusting device 21 may be a knurled nut.

In order to increase the flexibility in the upper area of the tiltable rear part, a recess 23 may be provided into which inserts with different strength properties may be inserted.

Figure 2:
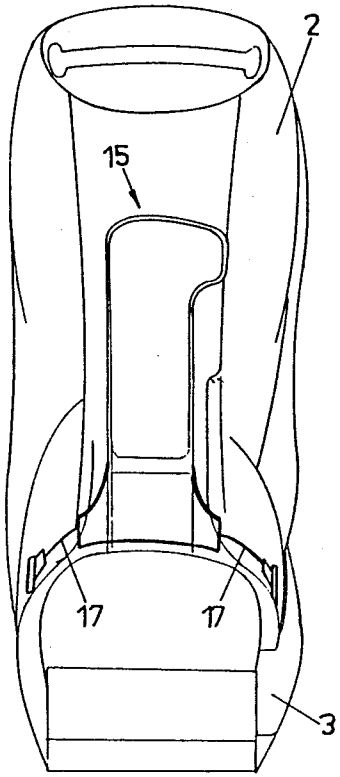
FIG. 2 is a view of the tiltable rear part of the ski boot according to FIG. 1.

FIG. 2 shows clamping elements 17 passing through to tightening device 15 in the rear area of the shoe which is constructed as a buckle. The clamping elements 17, in this case, are guided out through the tiltable rear part, and, in the area of the tightening buckle, are deflected in an upward direction. The tightening buckle may be of any arbitrary construction and may, for example, also make it possible to hang the clamping elements 17 at different levels. In a manner known in the art, the tightening buckle may also have a spindle located on the inside enabling vertical adjustment of the securing point of tightening elements 17.

Figure 3:
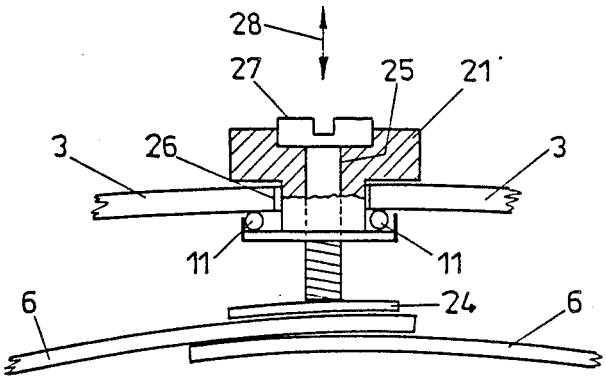
FIG. 3 is a sectional view according to Line III—III of FIG. 1.

In FIG. 3, a vertically adjustable pressure element 24 is shown which permits vertically adjustable pressure distribution in the instep area. In a bore 25 in the adjusting device 21 that, by means of an opening 26, penetrates the shell 3, a pin 27 is arranged that can be vertically adjusted and that can be screwed in a simple way. By rotating pin 27, the pressure element is displaced vertically in the direction of double arrow 28, whereby an adjustment of pressure is made possible that effects the tabs 6. The suspension of the tension elements 11 at the adjusting device 21 is outlined in the area between shell 3 and pressure element 24.

I claim:

1. A system for securely and comfortably holding a foot in a boot, particularly in the heel and instep regions, comprising:

a shell covering at least the instep region;

tiltable rear part means for closing the boot;

tension element means for applying securing force to both the heel and instep regions of the foot;

deflection point means for directing said tension element means in the ankle region of the boot;

counterpressure means for counteracting in the heel region the securing force applied by said tension element means to the instep region, wherein said counterpressure means is covered by said tiltable rear part means when the boot is closed; and clamping element means associated with said tension element means in the area of said deflection point means for distributing force to said tension element means.

2. The system of claim 1, further comprising tightening device means for applying force to said clamping element means, wherein said tightening device means is located on the exterior surface of the boot and wherein said tightening device means is connected to the boot along a swivel axis extending transversely to the longitudinal direction of the shoe.

3. The system of claim 2, wherein said clamping element means is connected with a second, movable deflection point.

4. The system of claim 3, wherein said tension element means is formed as a closed loop.

5. The system of claim 3, wherein said counterpressure means is an elastically deformable part connected to the shell and extending upwardly with respect to the sole of the boot to a height which is less than the height of said tiltable rear part means.

6. The system of claim 5, wherein a plurality of securing points are arranged on said counterpressure means at different levels with respect to the sole of the boot.

7. The system of claim 6, wherein said tension element means is deflected in the instep area around axis below said shell that cross the plane of the sole of the boot.

8. The system of claim 7, wherein said tension element means crosses itself in at least one location in the instep region.

9. The system of claim 8, further comprising adjusting device means located at a crossing point of said tension element means in the instep region for displacing said tension element means along the longitudinal axis of the boot.

10. The system of claim 9, further comprising tabs connected to opposing lateral edges of the sole of the boot and overlapping each other in the instep region, wherein said tension element means exert pressure on said overlapping tabs.

11. The system of claim 10, wherein said tension element means includes two free ends, each of which is connected to a separate one of the overlapping tabs at a point along the longitudinal center plane of the boot.

12. The system of claim 11, further comprising stop means for limiting the adjustment path of said tension element means.

13. The system of claim 12, wherein said deflection point means is slidably movable in the longitudinal direction of the boot while overcoming the force of a spring.

14. The system of claim 13, wherein said deflection point means is a pulley.

15. The system of claim 14, wherein said pulley has a profile and is formed with a lined circumferential groove for increasing friction and wherein the rotating motion of said pulley may be regulated.

16. The system of claim 15, further comprising vertically adjustable pressure element means located at a crossing point of said tension element means in the instep region for exerting vertical pressure on said overlapping tabs.

17. A system for securely and comfortably holding a foot in a boot, particularly in the heel and instep regions, comprising:

a shell covering at least the instep region;

tiltable rear part means for closing the boot;

tension element means for applying securing force to both the heel and instep regions of the foot;

deflection point means for directing said tension element means in the ankle region of the boot;

an elastically deformable shell part including at least one securing point situated at a level between said deflection point means and the instep region for securing said tension element means to said elastically deformable shell part, wherein said elastically deformable shell part is covered by said tiltable rear part means when the boot is closed and wherein the height of said elastically deformable shell part is less that the height of said tiltable rear part means; and clamping element means associated with said tension element means in the area of said deflection point means for distributing force to said tension element means.

18. The system of claim 17, further comprising tightening device means for applying force to said clamping element means, wherein said tightening device means is located on the exterior surface of the boot and wherein said tightening device means is connected to the boot along a swivel axis extending transversely to the longitudinal direction of the shoe.

19. The system of claim 18, wherein said clamping element means is connected with a second, movable deflection point.

20. The system of claim 19, wherein a plurality of securing points are arranged on said elastically deformable shell part at different levels with respect to the sole of the boot.

21. A system for securely and comfortably holding a foot in a boot, particularly in the heel and instep regions, comprising:

a shell covering at least the instep region;

tiltable rear part means for closing the boot;

tension element means for applying securing force to both the heel and instep regions of the foot;

first deflection point means for directing said tension element means in the ankle region of the boot;

an elastically deformable shell part which is covered by said tiltable rear part means when the boot is closed and wherein the height to said elastically deformable shell part is less that the height of said tiltable rear part means;

securing point means for securing said tension element means to said elastically deformable shell part and for controlling and directing the distribution of securing forces applied by said tension element means, wherein said securing point means are situated at different levels with respect to the sole of the boot between said deflection point means and the instep region;

clamping element means associated with said tension element means in the area of said reflection point means for distributing force to said tension element means;

tightening device means for applying force to said clamping element means, wherein said tightening device means is located on the exterior surface of the boot and wherein said tightening device means is connected to the boot along a swivel axis extending transversely to the longitudinal direction of the shoe; and second deflection point means for ensuring an even distribution of tensional force from said tightening device means to said clamping element means.

22. The system of claim 21, wherein said tension element means crosses itself in at least one location in the instep region.

23. The system of claim 22, further comprising adjusting device means located at a crossing point of said tension element means in the instep region for displacing said tension element means along the longitudinal axis of the boot.

24. The system of claim 23, further comprising tabs connected to opposing lateral edges of the sole of the boot and overlapping each other in the instep region, wherein said tension element means exert pressure on said overlapping tabs.

25. The system of claim 24, wherein said deflection point means is slidably movable in the longitudinal direction of the boot while overcoming the force of a spring.

26. The system of claim 25, further comprising vertically adjustable pressure element means located at a crossing point of said tension element means in the instep region for exerting vertical pressure on said overlapping tabs.

* * * * *